US005803297A

United States Patent [19]

Vasquez

[11] Patent Number: 5,803,297

[45] Date of Patent: Sep. 8, 1998

[54] CONTAINER LID

[76] Inventor: Rey Vasquez, P.O. Box 1841, Wilmington, Calif. 90748

[21] Appl. No.: 768,068

[22] Filed: Dec. 16, 1996

[51] Int. Cl.[6] ..... B65D 25/28

[52] U.S. Cl. ..... 220/212.5; 220/318; 220/328; 220/335

[58] Field of Search ..... 220/212.5, 254, 220/264, 285, 317, 318, 327, 328, 335; 216/57, 58

[56] References Cited

U.S. PATENT DOCUMENTS

| | | | |
|---|---|---|---|
| 4,036,396 | 7/1977 | Kennedy et al. | 220/242 |
| 4,134,516 | 1/1979 | Sullo | 220/242 |
| 4,236,746 | 12/1980 | LaVoie | 220/335 X |
| 4,624,385 | 11/1986 | Yano | 220/264 |
| 4,669,640 | 6/1987 | Ando et al. | 222/541 |
| 5,452,820 | 9/1995 | Mislavsky | 220/335 |
| 5,577,646 | 11/1996 | White | 220/335 X |
| 5,582,316 | 12/1996 | Masayoshi et al. | 220/264 |

*Primary Examiner*—Stephen Cronin
*Attorney, Agent, or Firm*—Roger A. Maras

[57] ABSTRACT

A lid for a container holding a hot liquid, such as hot asphalt or the like is provided having a section releasably fixed to the edge of the container and a movable section carried on the fixed section adapted to alternately open or close the opening leading into the container. A spring biasing arrangement coupled between adjacent edges of the sections normally biases the movable section into a closed position and hasp and retainer are employed for holding the movable section in an open position.

8 Claims, 3 Drawing Sheets

FIG. 1
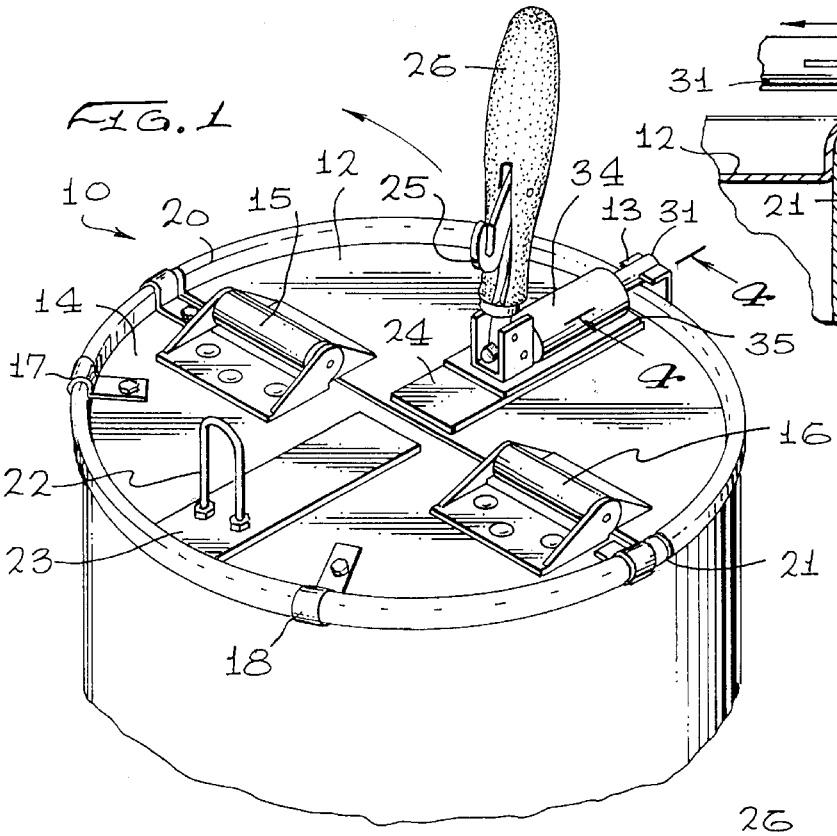
FIG. 4
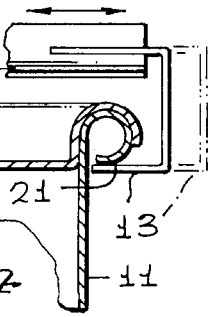
FIG. 2
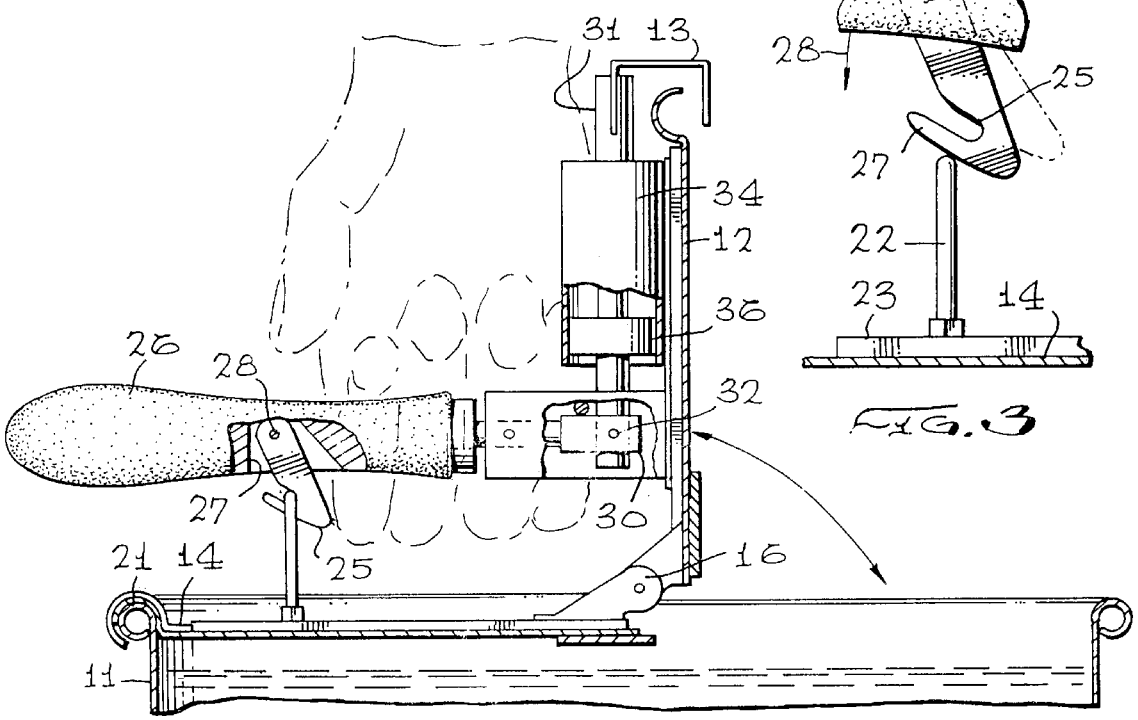
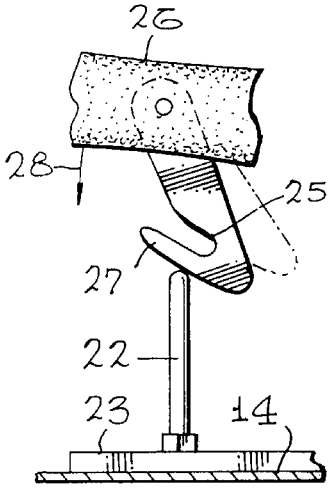
FIG. 3

CONTAINER LID

BACKGROUND OF THE INVENTION

1. Field of the Invention

The present invention relates to the field of industrial containers holding a quantity of hot substances, such as asphalt or the like, and more particularly to a novel lid having a first section fixed to the container and a second section pivotally mounted onto the first section so that the opening leading into the interior of the container can be selectively closed and so that the container can be transported from place to place without spillage.

2. Brief Description of the Prior Art

In the past, it has been the conventional practice to transport hot substances, such as tar, asphalt or the like from a portable reservoir on a vehicle to a work site, such as a roof, by means of a five-gallon container. Oftentimes, the hot substance spills over the opening leading into the interior storage cavity of the container so that the hot substance mars the surface on which it makes contact and, oftentimes, injures the person carrying the container. Damage and injury caused by spillage of hot substance is substantial and causes delay in construction and work performance.

Attempts have been made to provide covers for containers which generally include a single disc-type lid which incorporates clips about its peripheral edge for releasable connection to the edge of the container. Also, two-part lids have been provided which are connected together by a hinge so that only a part of the opening of the container is available. Problems and difficulties have been encountered with these conventional types of lids which stem largely from the fact that substantial time must be taken to install or remove a single part lid while a two-part lid does not provide a means for carrying or transporting the covered container from one place to another. Also, no means is provided on the two-part lid for resiliently biasing one part into a closed position and does not include means for holding the one part open while the second part is used for closure. Typical examples of conventional covers or lids for buckets, pails or open containers is disclosed in U.S. Pat. Nos. 5,452,820; 2,812,100; 2,747,388; 2,613,843 and 2,138,537. Although all of these lids or covers manage to seal an opening leading into the cavity of the container, none include a combination which permits the user to manually carry the container from place to place or which permits spring-biasing of the one part into a closed position and further which includes a latch or hold-down means for retaining half of the lid in a closed position or retaining this latter half in an open position.

Therefore, a long-standing need has existed to provide an anti-splash lid or cover for a container holding hot roofing asphalt or the like wherein the lid is in two half sections with one half clipped to the edge of the container and the other half hinged with a spring-bias to a closed position. Also, means must be employed to permit locked closure of the lid as well as a handle to be employed for transport purposes.

SUMMARY OF THE INVENTION

Accordingly, the above problems and difficulties are avoided by the present invention which provides a novel lid or cover for a container holding a hot substance or liquid, such as tar or asphalt, and which is provided with a pair of half sections wherein one section is releasably fixed by clip members to the edge of the container and a movable section hingeably carried on the fixed section that is adapted to alternately open or close the opening leading into the storage cavity of the container. Spring-biasing means is coupled between the adjacent edges of the sections so as to normally bias the movable section into a closed position and a retaining means is provided for holding the movable section in either the closed position or the open position. The retainer means further includes a handle suitable for grasping by the user for transport of the container from place to place.

Therefore, it is among the primary objects of the present invention to provide a novel lid or cover for a container which is in two sections having one section fixed to the edge of the container opening and the other section hingeably carried on the first section adapted to be moved between a closed position and an open position with respect to the opening of the container.

Another object of the present invention is to provide a novel retention and transport means for manually carrying a closed container from place to place that is mounted or carried on the cover or lid and which further permits a portion of the cover or lid to be moved between an open or a closed position.

Still a further object of the present invention is to provide a novel cover or lid for a container enclosing a quantity of hot substance, such as tar or asphalt, and which permits a partial opening of the lid to permit pourage of the substance from the container under a controlled condition while further including means for biasing the cover or lid into a closed position to prevent undesired spillage or release of the substance from the container.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view showing the novel lid or cover incorporating the present invention as carried by a container of hot substance;

FIG. 2 is an enlarged fragmentary view, in cross-section, illustrating the novel lid having a fixed section and a movable section illustrated in its open position;

FIG. 3 is an enlarged side elevational view of the retention means shown in FIG. 2 preparatory for engagement so as to releasably hold the movable section in an open position;

FIG. 4 is a fragmentary sectional view of a clip holding the retention mechanism as well as a part of the lid onto the edge of the container;

DESCRIPTION OF THE PREFERRED EMBODIMENT

Figure 5:
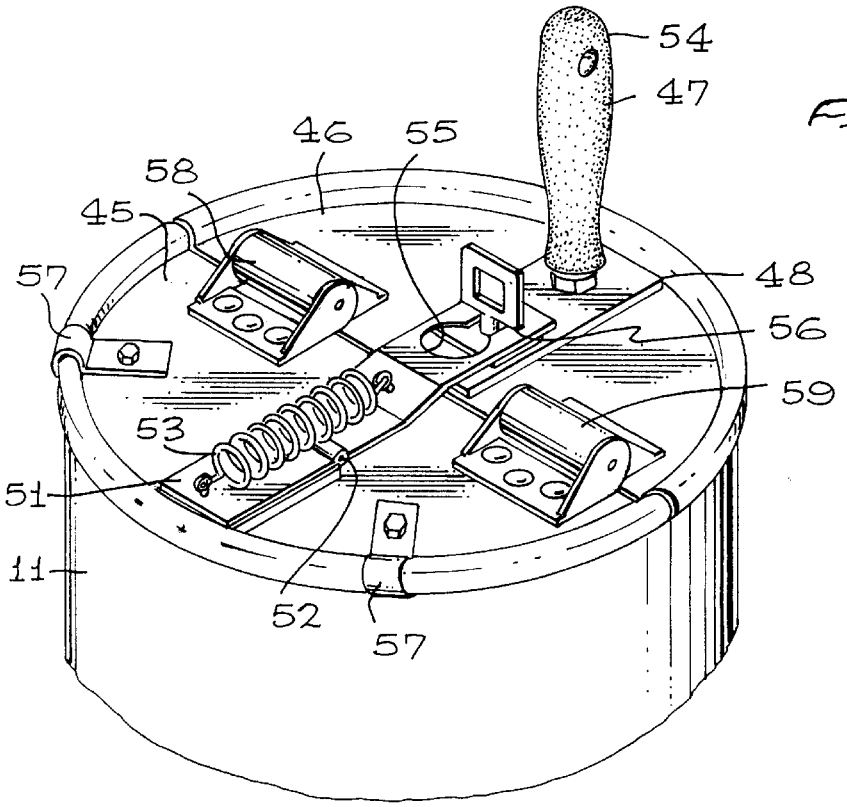
FIG. 5 is a perspective view of another embodiment of the present invention.

Referring to FIG. 1, the novel lid or cover of the present invention is illustrated in the general direction of arrow 10 which is placed on top of an industrial container 11 that holds a quantity of hot substance, such as tar, asphalt or the like. Such materials are commonly held in containers in the roofing industry and a need exists to prevent spillage through the opening leading into the container. The lid 10 includes a fixed section 12 that is releasably secured to the upper edge of the opening leading into the internal storage compartment of the container 11 by means of clips, such as clip 13. The movable section 14 of the lid 10 is hingeably connected to an adjacent edge of the section 12 by spring-loaded hinges 15 and 16. When in the closed position, as illustrated in FIG. 1, the section 14 is retained closed by a plurality of clips, such as clips 17 and 18. It is to be noted that the periphery of the lid or cover 10 includes a raised channel, broadly indicated by numeral 20 which is fitted or nested over a beaded edge provided on the container 11 about the opening leading into its internal storage compartment. A portion of the container bead is indicated by numeral 21 shown between the lid sections 12 and 14 when the lid is closed.

FIGS. 1 and 2 further illustrate a means for securing the movable lid section 14 to the fixed lid section 12 which includes a loop or eyelet 22 that is carried on the exposed face of the lid section 14. The loop may be carried on a reinforcing plate 23 so that a firm connection and additional support is given to the section 14. In a similar manner, a reinforcing plate 24 is provided on the exposed surface of the fixed lid section 12 that supports a hook 25 suitable for engaging with the eyelet 22 when the hook is in the position shown in FIG. 2. The hook 25 is pivotally attached to a handle 26 within a groove 27 by means of pivot 28. Therefore when the handle 26 is moved towards the eyelet 22, the front edge 27 of the hook 25 will engage with the eyelet, as shown in FIG. 3, and the eyelet will pivot rearwardly to the broken line position. As the handle is further moved in the direction of arrow 28 in FIG. 3, the end of the hook will pass over the eyelet and the hook will pivot forwardly because of gravity into a latching arrangement, as shown in FIG. 2.

The handle 26 is carried on a block 30 that is pivotally connected to the end of a rod 31 by means of a pivot 32. Such an arrangement permits the handle 26 to not only cause the hook 25 to engage with the eyelet but the handle may also be used when grasped by the user for lifting the container and its contents for transport from place to place. The user's finger can grip about either side of the hook so that the weight of the container can be accounted for.

Also, it can be seen in FIGS. 1 and 4 that the rod 31 is operable to move within housing 34 to permit the clip 13 to be in an installed position as shown in solid lines in FIG. 4 and moved away from bead 21 to the broken line position for release. The rod 31 may move back and forth within the housing, which is attached to the plate 24 via a subplate 35 and is supported within the housing 34 by a guide or piston-type element 36.

Figure 7:
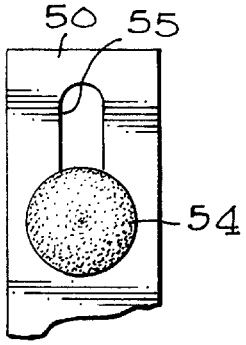
FIG. 7 is a sectional view of the retention means as taken in the direction of arrows 7—7 of FIG. 6.
Figure 6:
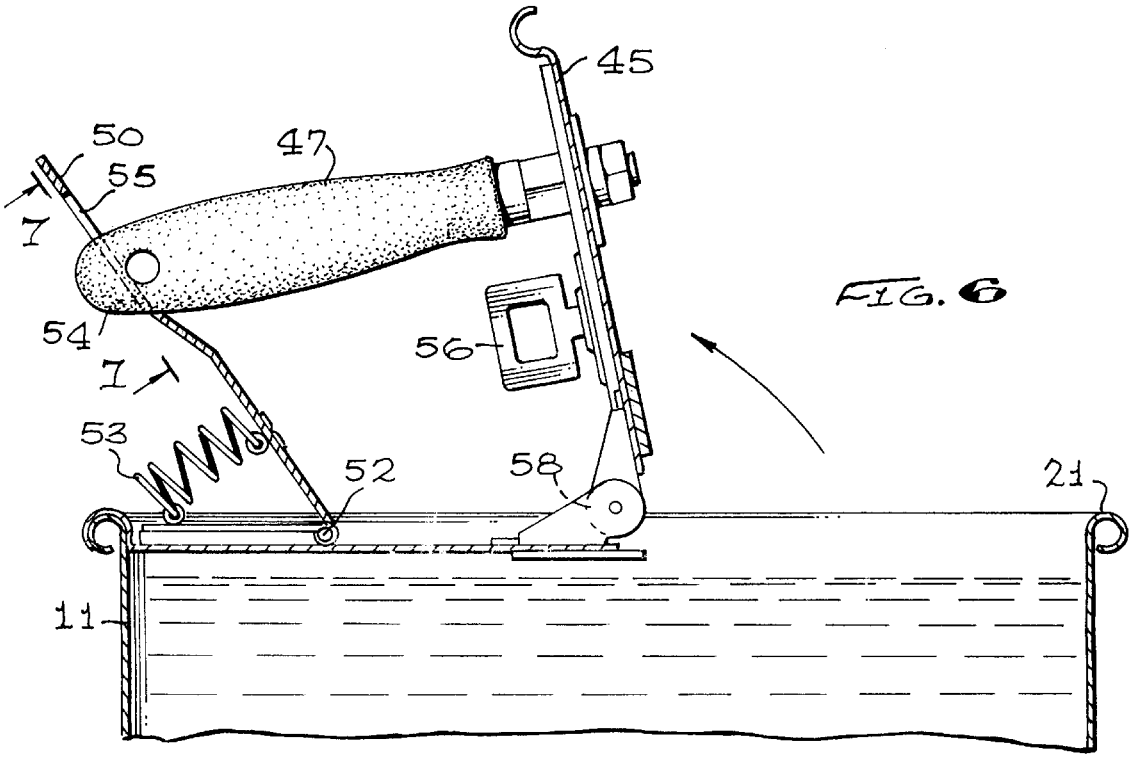
FIG. 6 is a sectional view of the embodiment shown in FIG. 5 with the movable section retained in an open position.

Referring now to FIGS. 5–7 inclusive, another embodiment of the present invention is illustrated wherein the retaining means or latch means for holding the movable lid cover section 46 with respect to a fixed section 45, wherein the handle 47 is directly secured in fixed position on the plate 48. The movable cover 46 includes a latch member 50 having one end hingeably connected to plate 51 by means of hinge 52. A helical spring 53 is disposed so that one end is connected to member 50 while the opposite end is connected to the member 51. Therefore, a constant bias is placed on the member 50 to be pulled into the position shown in FIG. 6. When in this position, the end 54 of the handle 47 may be inserted into an aperture 55 in the cantilevered end of member 50 so that a binding relationship is produced holding the lid cover section 46 in the raised position, as shown in FIG. 6.

When it is desired to maintain the movable lid section 46 open, the end of the handle, represented by numeral 54, is placed into the elongated aperture connected to the slot, as represented by numeral 55 and as shown in FIG. 7.

When it is desired to maintain the movable lid section 46 in the closed position, as shown in FIG. 1, a pivoting key or latch 56 is introduced through the opening 55 and slot 50 whereupon the key or latch is twisted so as to maintain the member 50 against plate 48. If desired, the user may place a lock, such as a chain, cable or the like through an eyelet in the latch of key 56 in order to maintain the movable section 46 closed.

The fixed section 45 is releasably connected to the edge bead of the container 11 by means of clips such as clip 57, as previously described with respect to the embodiment in FIG. 1. The movable lid section 46 is hingeably connected to the fixed section 45 by spring-biasing hinges 58 and 59. The springs cause the moving lid section 46 to be biased into a normally closed position, as shown in FIG. 1.

Therefore, it can be seen from the foregoing that the container 11 when holding a quantity of hot substance, will not permit spillage of the substance when the lid 10 is placed over the opening leading into the storage compartment of the container. At this point, the user may readily carry the container from place to place by gripping the handle 26 with respect to FIG. 1 or handle 47 with respect to the embodiment shown in FIG. 5. In either embodiment, the movable section may be released from either its hooked or handle-interfering relationship with the hole 55 so that the movable lid section can be rotated to the open positions shown in FIGS. 2 and 6 respectively.

Referring to FIGS. 8–11, another embodiment of the present invention is illustrated in the general direction of arrow 60 which includes a first section 61 which is removably coupled to the edge of container 62 by means of an interlocking flange 63 and clips or clamps, such as clamp 64. This is a similar arrangement as previously described. Also, a positionable section 65 is illustrated which is coupled to the section 61 by hinges 66 and 67 in a manner as previously described. Additionally, the movable or positionable section 65 includes handle 68 which is fixed to the exterior surface of lid 65 by plate 70.

Figure 8:
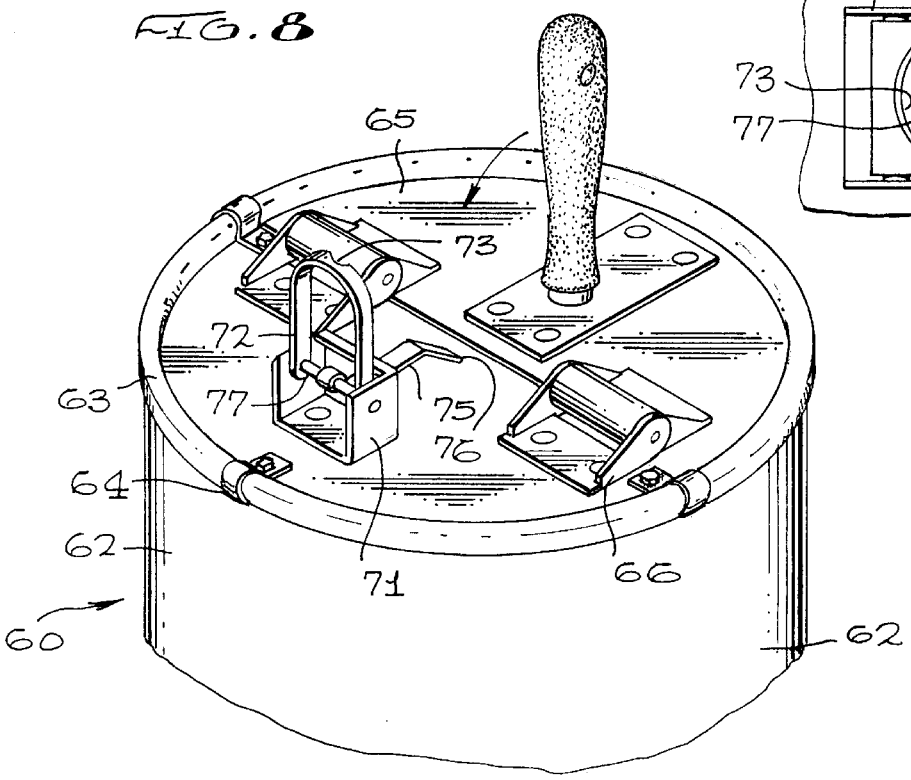
FIG. 8 is a partial perspective view of another embodiment of the invention.
Figure 9:
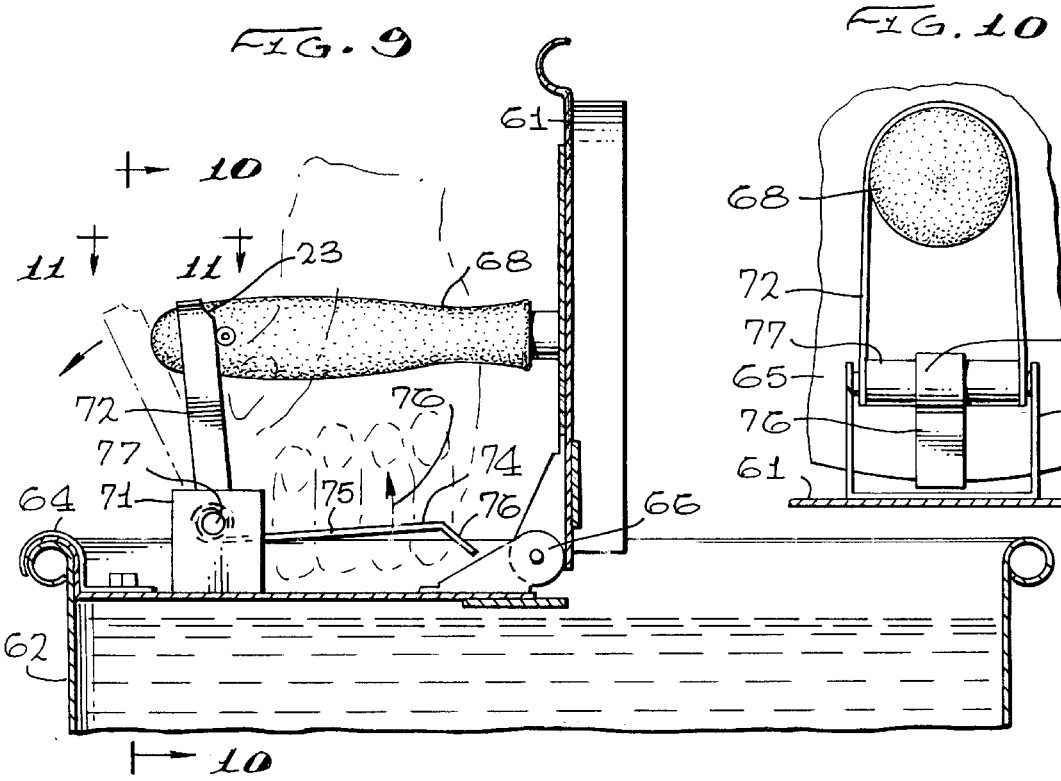
FIG. 9 is a sectional view of the embodiment shown in FIG. 8 illustrating the lid in its open position.

The embodiment shown in FIG. 8 further includes a yoke or bracket 71 on which a latch member 72 is pivotally carried. The latch 72 includes a holding notch 73 for engaging with the handle 68 when the handle is in the position as shown in FIG. 9. As the lid 65 is pivoted on the hinges 66 and 67, the handle 68 is brought into contact with the latch and the notch which causes the latch 68 to pivot into the position shown in broken lines in FIG. 9. As the handle 68 is further depressed into the central opening of the latch, the latch 72 will automatically move from the dotted line position to the solid line position due to the weight of the stand-off member 75. It can be seen that the stand-off member 75 includes a foot 76 that rests against the surface of the fixed lid section 61 when the latch is in the solid line position. However, when the latch is pivoted to the broken line position, the stand-off member moves upwardly in the direction of arrow 76. It can be seen, particularly in FIG. 8, that the stand-off member 75 is fixedly secured to a pivot 77 which pivotally mounts the latch 77 onto the bracket 71.

FIG. 9 further illustrates that when the handle is within the opening of latch 72, the latch will move forward so that the stand-off member 75 will again rest foot 76 against the upper surface of the lid section 61. Even though the spring tension of hinges 66 and 67 urges or biases the movable section 65 into its closed position, the engagement of the latch 72 with the handle 68 will prevent such movement.

Figure 10:
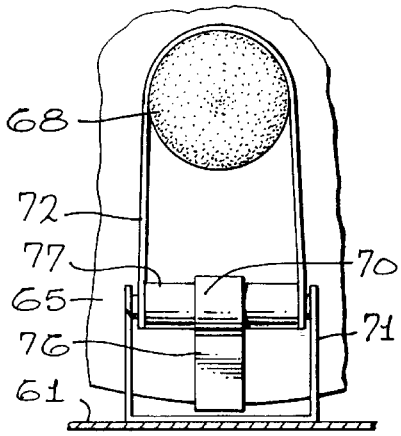
FIG. 10 is a sectional view as taken in the direction of arrows 10—10 of FIG. 9.

Referring now to FIG. 10, it can be seen that the end of the member 75 is fixedly secured to the pivot 77, as represented by numeral 78. Also, it can be seen that the handle 68 is within the central opening of the latch 72, as previously described. This is a holding position and the foot 76 may or may not rest against the surface of lid section 61. However, it is understood that when the handle 68 is depressed further into the opening of the latch 72, the latch can be pivoted rearward to the position in broken lines shown in FIG. 9 whereby the foot 76 would raise above the surface of section 61 and since the latch is in a rearward position, the handle can then travel past the latch and the movable lid section 61 can be returned to the closed position, as shown in FIG. 8.

Figure 11:
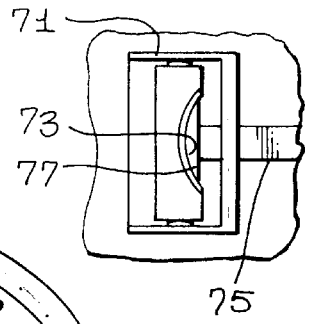
FIG. 11 is a fragmentary top plan view of the handle and latch shown in FIG. 9 as taken in the direction of arrows 11—11 thereof.

FIG. 11 further emphasizes the usefulness of notch 77 in latch 72 whereby when the handle is moved towards the latch as the movable lid 65 is opened, the rounded surface of the handle will bear against the rounded or tapered surface of the notch 73 which pushes the latch into the pivoted position in broken lines shown in FIG. 9. Again, once the handle has passed the upper portion or hasp of the latch, the latch will then move forward to the solid line position because of the weight of member 75 to the position shown in FIG. 10.

In the closed position, as shown in FIG. 8, the roofing or tar materials within the container 62 are maintained and spillage is avoided. When it is desired to move the container from one place to another so that the contents can be dispensed, the handle is then moved to the position shown in FIGS. 9 and 10 and as shown in these figures, the handle 68 can be grasped by the hand of the user and the open bucket can be carried from one place to another with safety.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A container lid comprising:

a pair of sections hinged together to provide a fixed section and a movable section movable with respect to said fixed section;

said sections having opposing edge marginal regions;

a hinge mechanism carried on said edge marginal region of each of said sections permitting movement of said movable section within at least a 90 degree angular range of movement constituting an open position;

spring biasing means having opposite ends secured respectively to said edge marginal regions normally urging said movable section to a closed position coextensive with said fixed section;

latch means cooperatively carried on said fixed section and said movable section for retaining said movable section in said open position;

said latch means includes an elongated handle fixed to said movable section; and a latch pivotally carried on said fixed section having a retainer for selectively engaging and holding said handle when said movable section is in said open position.

2. The invention as defined in claim 1 wherein:

said retainer is a hook and further includes a loop secured to said fixed section for releasably engaging with said hook.

3. The invention as defined in claim 2 including:

spring means for releasably engaging said hook with said loop.

4. The invention as defined in claim 1 wherein:

said retainer is pivotally carried on said fixed section and includes a spring normally urging said latch into engagement with said handle.

5. The invention as defined in claim 1 wherein:

said latch includes an opening constituting said retainer for receiving said handle in an interference fit to maintain said movable section in said open position.

6. The invention as defined in claim 5 including:

an elongated rigid stop carried on said latch and urging said latch into an upright position normal to said fixed section so as to receive said handle in said retainer opening to releasably hold said movable section in said open position.

7. The invention as defined in claim 6 wherein:

said rigid stop maintains said latch in said upright position via gravitational forces.

8. The invention as defined in claim 7 wherein:

said maintenance of said rigid stop in said upright position is yieldable upon forcible engagement of said handle with said retainer.

* * * * *